US009345983B2

(12) United States Patent
Meys

(10) Patent No.: US 9,345,983 B2
(45) Date of Patent: May 24, 2016

(54) CONSTRUCTION KIT

(75) Inventor: Jean-Michel Meys, La Croix sur Lutry (CH)

(73) Assignee: EQUIMODUS SARL, La Croix sur Lutry (CH)

( * ) Notice: Subject to any disclaimer, the term of this patent is extended or adjusted under 35 U.S.C. 154(b) by 612 days.

(21) Appl. No.: 13/636,096

(22) PCT Filed: Mar. 18, 2011

(86) PCT No.: PCT/IB2011/051147
§ 371 (c)(1),
(2), (4) Date: Sep. 19, 2012

(87) PCT Pub. No.: WO2011/114315
PCT Pub. Date: Sep. 22, 2011

(65) Prior Publication Data

US 2013/0012098 A1 Jan. 10, 2013

(30) Foreign Application Priority Data

Mar. 19, 2010 (CH) ..... 403/10

(51) Int. Cl.
*A63H 33/04* (2006.01)
*A63H 33/10* (2006.01)
*A63H 33/06* (2006.01)

(52) U.S. Cl.
CPC ..... *A63H 33/101* (2013.01); *A63H 33/04* (2013.01); *A63H 33/062* (2013.01); *A63H 33/10* (2013.01)

(58) Field of Classification Search
CPC ..... A63H 33/04; A63H 33/10; A63H 33/101; A63H 33/102; A63H 33/106; A63H 33/107; A63H 33/108; A63H 33/06; A63H 33/062; A63H 33/067; A63H 33/08; A63H 33/086; A63H 33/088
See application file for complete search history.

(56) References Cited

U.S. PATENT DOCUMENTS 1,472,536 A * 10/1923 Thomson ..... A63H 33/108 211/189
2,841,919 A * 7/1958 McNeill ..... A63H 33/044 446/115

(Continued)

FOREIGN PATENT DOCUMENTS

BE WO 9858716 A1 * 12/1998 ..... A63F 9/088
GB 1566598 A 5/1980

(Continued)

OTHER PUBLICATIONS

Translation of WO9858716A1.*

(Continued)

*Primary Examiner* — Gene Kim
*Assistant Examiner* — Alyssa Hylinski
(74) *Attorney, Agent, or Firm* — Faegre Baker Daniels LLP

(57) ABSTRACT

Construction kit including construction blocks (2) and connection parts (4, 4', 4'', 4''', 6) for coupling the construction blocks. The construction blocks comprise openings (18) for the insertion of the connection parts formed by a pair of constituent elements (4*a*) pivoting with respect to one another. The rim (26) of the opening comprises eight or more teeth (22) distributed over the periphery of the opening. Some of the connection parts comprise teeth (68) arranged in a groove (66) which are configured to interlock with the teeth (22) of the rim when the connection part is in the locking position.

13 Claims, 13 Drawing Sheets

(56) References Cited

U.S. PATENT DOCUMENTS

| | | | | |
|---|---|---|---|---|
| 3,195,266 | A * | 7/1965 | Onanian | A63H 33/101 174/138 D |
| 3,691,704 | A | 9/1972 | Novak | |
| 4,430,826 | A * | 2/1984 | Ryaa | A63H 33/088 403/64 |
| 4,509,930 | A * | 4/1985 | Schweigert | A63H 33/065 220/4.29 |
| 5,664,387 | A * | 9/1997 | Bhatti | A63H 33/108 446/102 |
| 5,938,497 | A * | 8/1999 | Mott | A63H 33/10 446/122 |
| 8,157,470 | B2 * | 4/2012 | De Wilde | A63H 33/106 403/348 |
| 2003/0208979 | A1 * | 11/2003 | Sorensen | A63H 33/062 52/591.1 |
| 2006/0099375 | A1 * | 5/2006 | Lee | A63H 33/04 428/53 |
| 2006/0131989 | A1 * | 6/2006 | Daftari | A63H 33/046 310/309 |
| 2009/0239712 | A1 * | 9/2009 | Van Raalte | A63B 69/0048 482/35 |

FOREIGN PATENT DOCUMENTS

| | | | |
|---|---|---|---|
| WO | 98/58716 | A1 | 12/1998 |
| WO | WO 9858716 | A1 * | 12/1998 |
| WO | 2004/067128 | A2 | 8/2004 |

OTHER PUBLICATIONS

The International Search Report and Written Opinion for PCT/IB2011/051147 as issued by the European Patent Office dated Sep. 21, 2011, 17 pp.

* cited by examiner

CONSTRUCTION KIT

The present invention concerns a construction kit comprising building blocks and connecting pieces to join together the building blocks.

A said system is described in publication WO 98/58716. The system is formed of cubes having six faces, each of the faces comprising an opening configured for the insertion of a semi-part of a connecting piece, the other semi-part of the connecting piece intended to be inserted in an opening of an adjacent cube. The coupling of two cubes is obtained by pressing the cubes towards each other causing the wings of the connecting piece to pivot towards a locked position. The connecting pieces can be inserted into each of the six faces so that it is possible to construct a structure of any shape using a multitude of blocks connected via one or more of their faces to other cubes. In a first variant, the cubes are free to rotate relative to the connecting piece about an axis orthogonal to the face in which the connecting piece is inserted. In a second variant, the cube is blocked in rotation with the connection piece via a lug on the connecting piece engaged in a notch on the edge of the opening. The cubes can therefore either rotate or be blocked in a position aligned with the adjacent cube.

It is a object of the invention to provide a polyvalent construction kit allowing numerous static and dynamic configurations.

It is advantageous to provide a construction kit comprising building blocks that are economical to manufacture.

It is a further object of the invention to produce a building block formed of separate elements which is rigid and stable in the assembled state, and in which the elements are economical to manufacture and easy to assemble.

Some objects of the invention are achieved with the building block according to claim 1. Other objectives of the invention are achieved with a connecting piece for building blocks according to claim 6 or according to claim 9. Other objectives of the invention are achieved with the construction kit according to claim 12.

A construction kit is described herein which includes building blocks and connecting pieces for joining the building blocks, the building blocks comprising face openings having a rim. The face connecting piece comprises a pair of constituent elements pivoting relative to one another, the constituent elements comprising a central body and wings configured to be inserted in the face opening. The wings comprise a groove arranged between a shoulder and an abutment configured to abut the rim of the face opening to cause the constituent elements to pivot from an insertion position to a blocking position, the shoulder being configured to engage an inner surface of the rim in the blocked position. The rim of the face opening is toothed and comprises eight teeth or more distributed over the periphery of the opening. At least some of the face connecting pieces comprise teeth arranged in at least one of the grooves of the wings configured to intermesh with the teeth of the rim in the blocked position.

The construction kit may also comprise corner connecting pieces which fit into corner openings of the building block. The corner connecting pieces may comprise elastic arms and a retaining shoulder at their free end to engage an inner edge of the corner opening. Depending on dimensions, the corner connecting piece may also be of similar model to the face connecting piece with or without teeth.

In one embodiment, at least some of the face connecting pieces comprise a splined central cavity configured for the insertion of a mating pin for the rotation of the connecting piece on the pin.

In one embodiment, at least some of the face connecting pieces comprise a pinion extending over at least one side of the connecting piece, configured to mesh with a pinion of another connecting piece when the connecting pieces are mounted in a building block. Some connecting pieces may comprise two pinions on opposite sides of the connecting piece.

In one embodiment, at least some of the face connecting pieces comprise a pinion extending from either side of the teeth arranged in at least one groove and configured to intermesh with the teeth of the rim of the face opening in the blocked position.

According to another aspect of the invention, a building block comprises separate elements, assembled or to be assembled. The building block comprises face walls and locking pieces. The face walls have edges defining the contour of the wall and the interface with adjacent face walls. The face walls forming the building block may all be identical. Each face wall comprises at least one male fixing part and one female fixing part arranged along each edge on an inner face, the male fixing parts mating with the female fixing parts. The male fixing part may be in the form of a lug or tongues and the female fixing part in the form of a notch into which the tongues or lugs of the male fixing part are press-fitted.

Each locking piece is configured to be mounted onto a corner of the block arranged at the intersection of three adjacent face walls. The locking piece comprises at least three locking parts, one to engage each of said three adjacent face walls. The locking parts may be in the form of tongues, each tongue comprising a locking bulge or shoulder at its end part, configured to engage with a mating locking shoulder of the face wall. The corner locking part of the face walls may comprise an orifice in which the tongues of the locking piece are inserted, the orifice being delimited on one side by an elastic bearing strip defining a locking shoulder.

Other objects and advantageous aspects of the invention will become apparent from the claims, from the detailed description of embodiments given below and from the appended drawings in which:

FIG. 1*a* is a partly exploded perspective view of a first example of a construction system according to one embodiment of the invention comprising building blocks and connecting pieces;

FIG. 1*b* is a perspective view of a second example of a construction system according to one embodiment of the invention comprising building blocks and connecting pieces, some walls of the building blocks being removed to see inside the blocks and connecting pieces;

FIG. 1*c* is a partly exploded perspective view of a third example of a construction system according to one embodiment of the invention comprising building blocks and connecting pieces;

FIG. 1*d* is a partly exploded perspective view of a fourth example of a construction system according to one embodiment of the invention comprising building blocks and connecting pieces;

FIG. 2*a* is a perspective view of two faces of a building block according to one embodiment of the invention, in the process of being assembled, as seen from the inside;

FIG. 2*b* is similar view to FIG. 2*a* with the two faces assembled;

FIG. 2*c* is a perspective view of three assembled faces of a building block as seen from the inside;

FIG. 2*d* is a view of the assembly in FIG. 2*c* as seen from the outside;

FIG. 2*e* is a view of a building block illustrating a last face wall in the process of being assembled to the remainder;

FIG. 2*f* is a perspective view of part of a building block with the six face walls assembled;

Figure 4A:
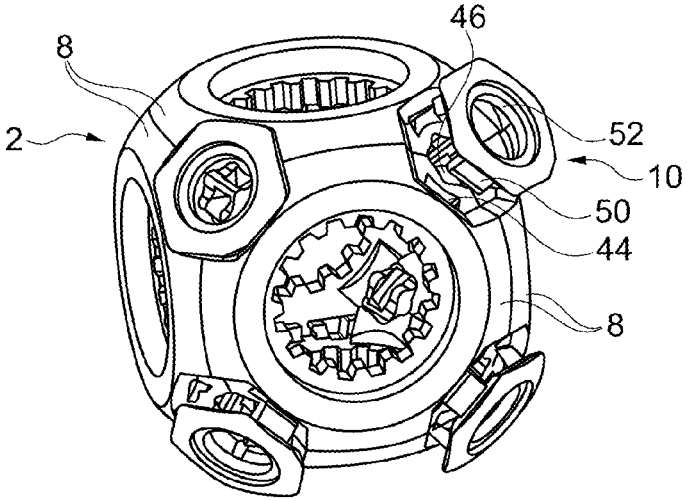
FIG. 4 is a perspective view of locking pieces in the process of being assembled onto the building block.
Figure 4B:
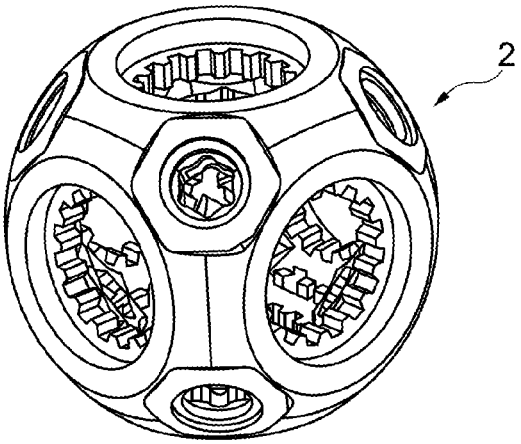
Figure 5A:
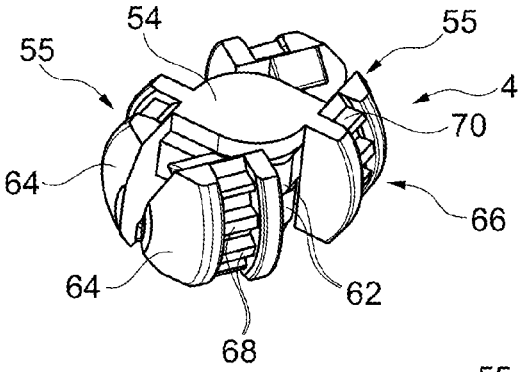
Figure 5B:
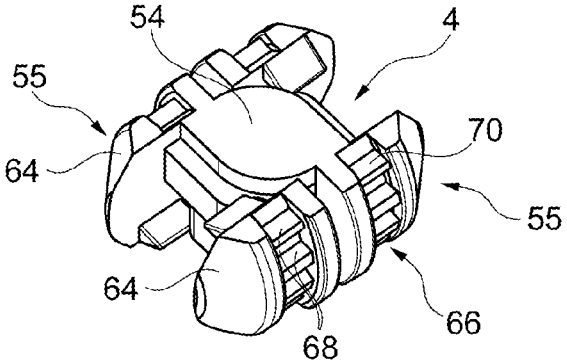
Figure 5C:
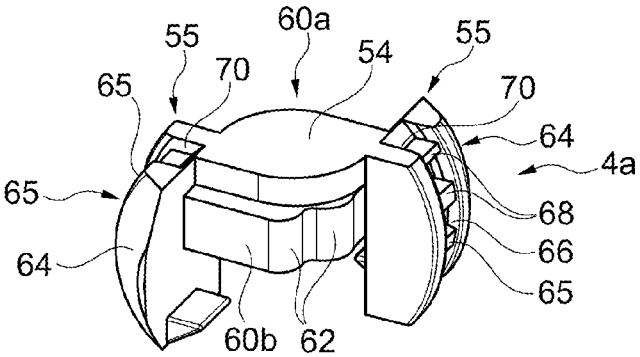
Figure 5D:
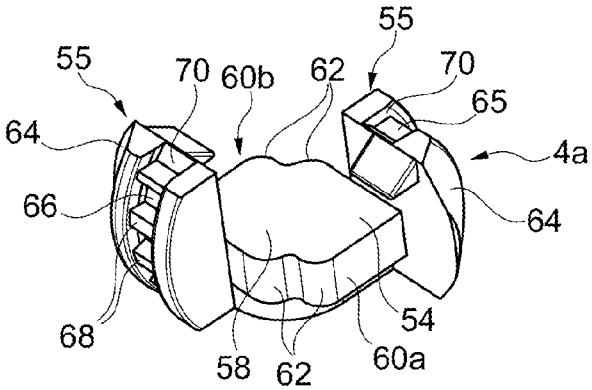
Figure 6A:
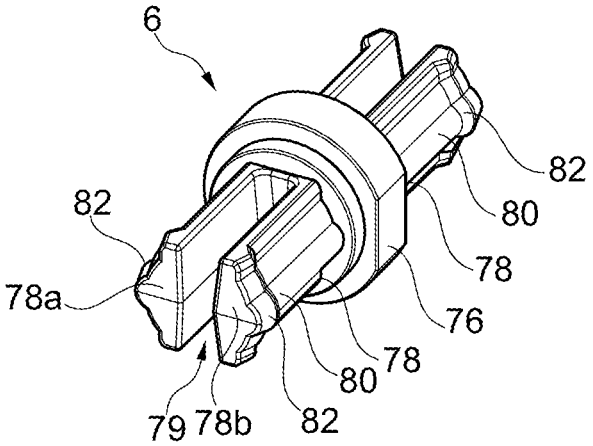
Figure 6B:
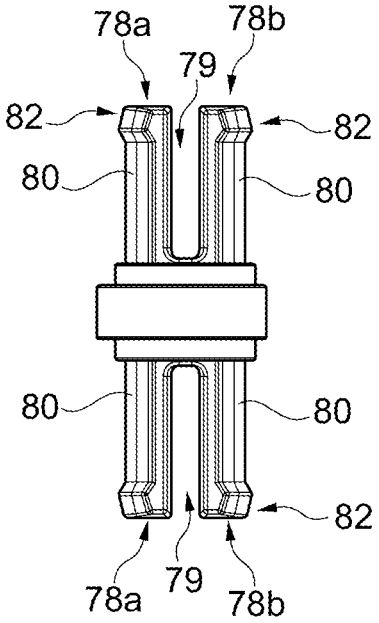

FIG. 4*b* is a perspective view of a building block according to one embodiment of the invention that is fully assembled;

FIGS. 5*a* and 5*b* are perspective views of a first variant of a face connecting piece according to one embodiment of the invention, in an insertion position (FIG. 5*a*) and blocking position (FIG. 5*b*) respectively;

FIGS. 5*c* and 5*d* are perspective views of a constituent element of the first variant of a face connecting piece;

FIG. 6*a* is a perspective view of a corner connecting piece according to one embodiment of the invention;

FIG. 6*b* is a side view of the connecting piece in FIG. 6*a;*

Figure 7A:
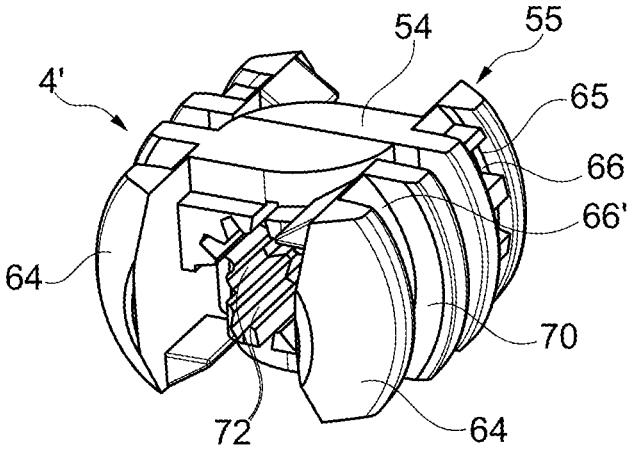
Figure 7B:
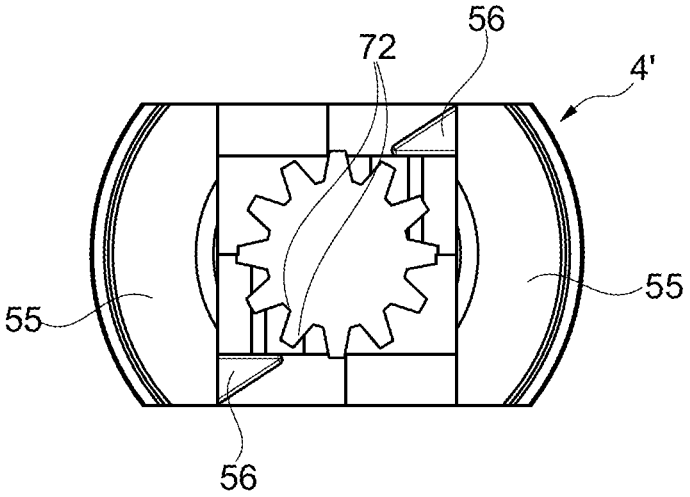
Figure 7C:
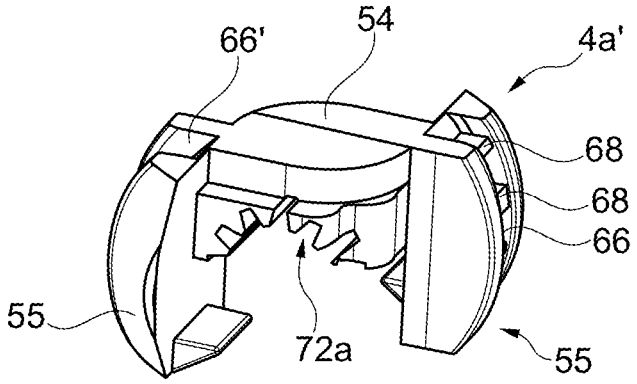
Figure 7D:
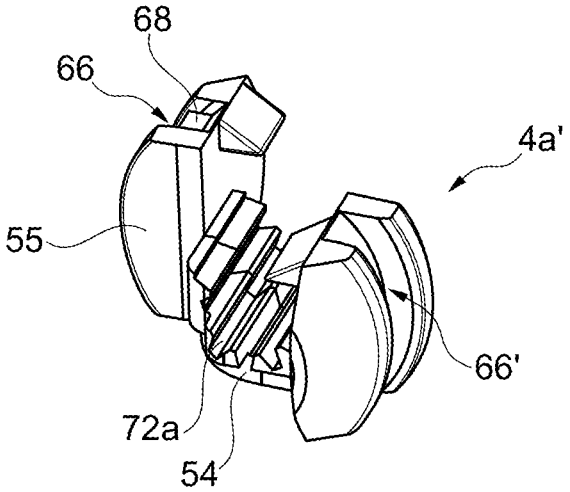
Figure 8A:
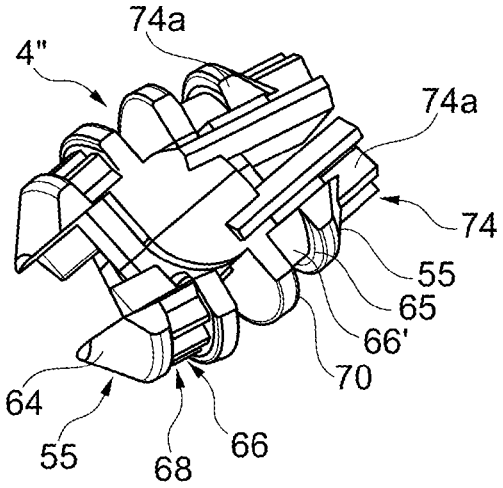
Figure 8B:
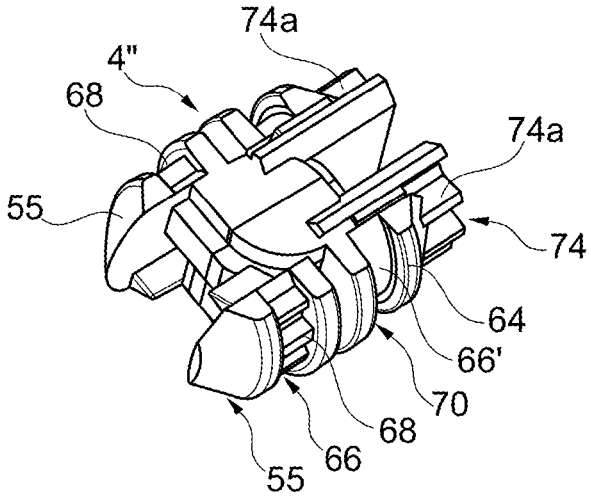
Figure 8C:
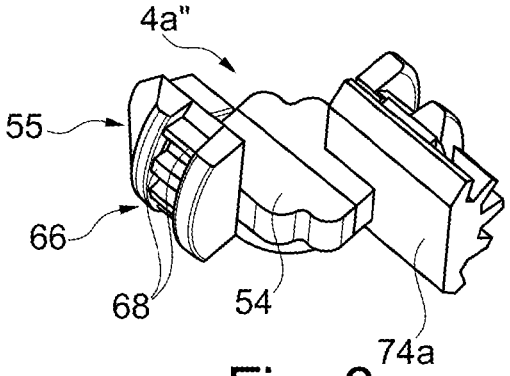
Figure 9A:
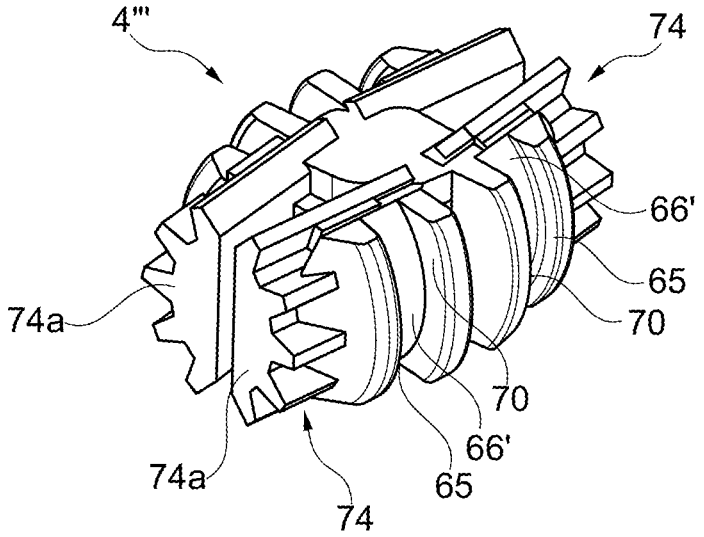
Figure 9B:
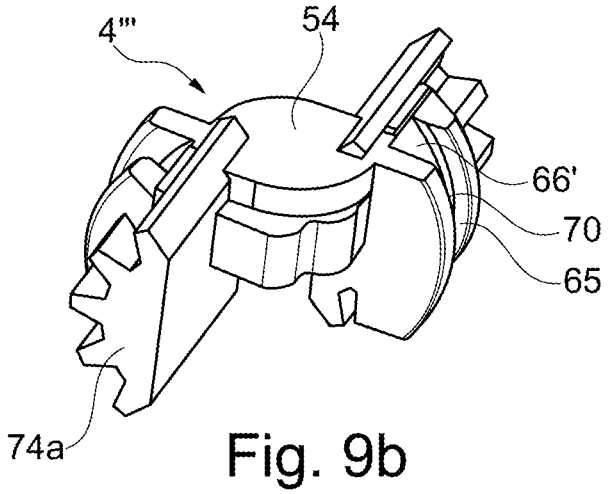
Figure 10:
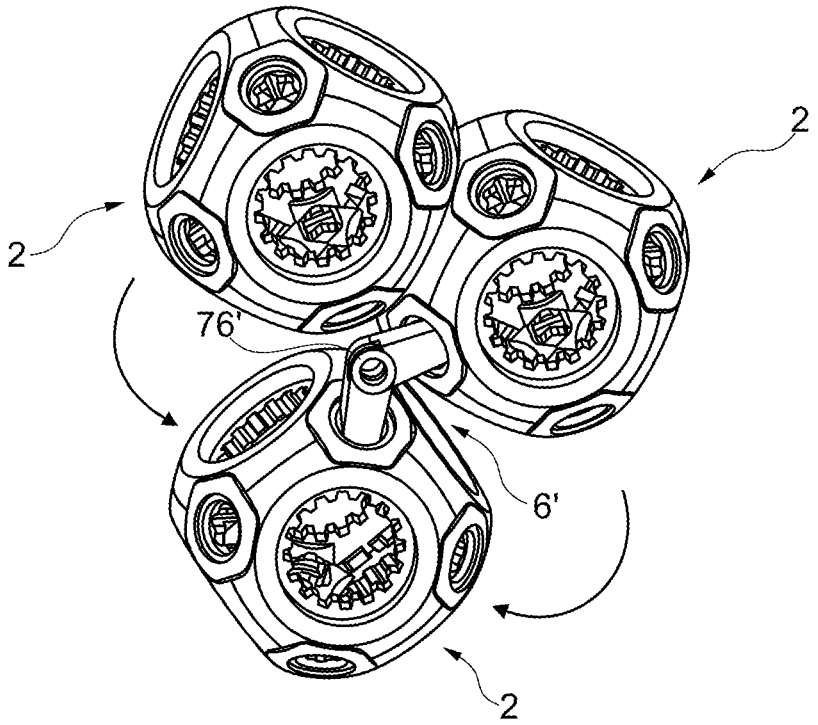
Figure 11:
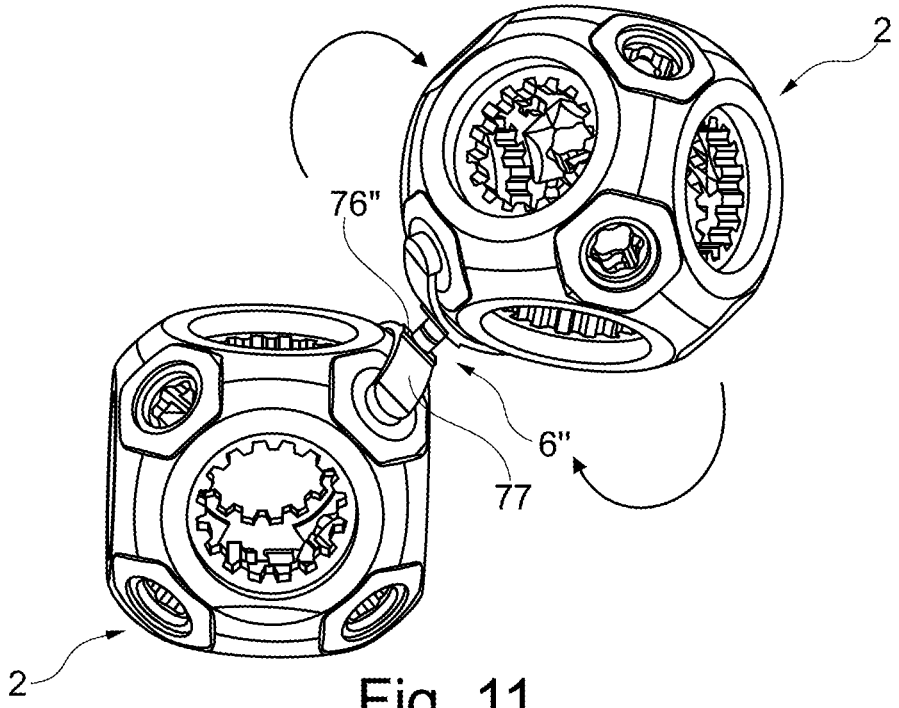

FIGS. 7*a* and 7*b* are perspective and plan views respectively of a second variant of a face connecting piece according to one embodiment of the invention, in blocked position;

FIGS. 7*c* and 7*d* are perspective views of a constituent element of the second variant of a face connecting piece;

FIGS. 8*a* and 8*b* are perspective views of a third variant of a face connecting piece according to one embodiment of the invention, in inserted position (FIG. 8*a*) and blocked position (FIG. 8*b*) respectively;

FIG. 8*c* is a perspective view of a constituent element of the third variant of a face connecting piece;

FIG. 9*a* is a perspective view of a fourth variant of a face connecting piece according to one embodiment of the invention, in inserted position;

FIG. 9*b* is a perspective view of a constituent element of the fourth variant of a face connecting piece; and FIGS. 10 and 11 are perspective views of examples of a construction system according to embodiments of the invention comprising building blocks and connecting pieces, showing variants of the corner connecting pieces.

With reference to the Figures, in particular FIGS. 1*a* to 1*d*, examples of constructions are illustrated formed of building blocks 2 connected to each other via face connecting pieces 4, 4' and 4" or via corner connecting pieces 6. Herein the notion of "corner" or "face" is used to make a distinction between the two different connecting means, but a "corner" or a "face" may assume different forms and even resemble one another. The building blocks may have different shapes, for example the shape of a cube with six faces, or pseudo-cubes formed of a spherical shape for example with the spherical caps removed to form six faces such as illustrated. The building blocks may however assume other three-dimensional forms having more or less six faces. The building blocks may have generally regularly shapes e.g. tetrahedron (pyramid), cube, sphere, parallelepiped, or even an irregular or complex shape. In one building block system according to the invention it is possible to have a plurality of building blocks having multiple different shapes.

With reference to FIGS. 2*a* to 2*f*, one embodiment of a building block according to one aspect of the invention is illustrated. The building block comprises face walls 8 having an inner side 16 and an outer side 14 and a central opening 18 through which a semi-part of a face connecting piece 4, 4', 4" is inserted.

In the illustrated embodiment, the face wall 8 is a separate element and separable from other face walls, the building block having six face walls which are assembled to define the six sides of a pseudo-cube. Advantageously, the six face walls 8 are of identical construction.

Each face wall 8 comprises edges 12 defining the outer contour of the wall and the interface with adjacent face walls once the block is assembled. The periphery of the central opening 18 forms a rim 26. The rim is toothed and comprises a plurality of teeth 22, preferably a least 8 teeth regularly spaced all around the central opening. A minor annular periphery 24 formed by the tip of the teeth 22 defines the passageway section for inserting the connecting piece. The rim 26 is configured to abut part of a flange forming an abutment 70 of the connecting piece to actuate locking of the connecting piece onto the block along the functioning principle known from document WO 98/58716. The periphery of the opening 18 may optionally comprise an annular seat 20 to house the abutment 70 of the connecting piece. In one preferred embodiment, the teeth 22 are spaced so as to define orientation positions of the connecting piece relative to the building block, at least every 22.5° i.e. allowing sixteen positions in rotation of the connecting piece relative to the face wall over the 360° forming a complete rotation.

On the inner surface of each wall there are male fixing parts 28 and mating female fixing parts 32. In the illustrated embodiment, there is a male fixing part and a female fixing part along each edge 12, each fixing part being configured to be coupled with a matching fixing part of an adjacent face wall when assembling face walls. The male fixing parts may advantageously be in the form of a lug or tongue 30 configured to be inserted in the female fixing part in the form of a notch 34, the tongues or lugs being elastically clipped into the notch. In the illustrated embodiment, the tongues 30 are in the form of elastic arms forming a "V" with end projections which come to be housed in corresponding notches of the female fixing part to retain the male fixing part elastically in the female fixing part, whilst allowing the parts to be uncoupled. Other forms of female and male fixing parts can be provided within the scope of this invention. For example, it can be envisaged to have tongues with ends in the form of an arrow head ensuring a permanent connection (non-dismountable) once coupled to the mating female fixing part. One of the fixing parts 31 may form an injection point in the variants in which the face walls are formed of injected plastic material.

Figure 2A:
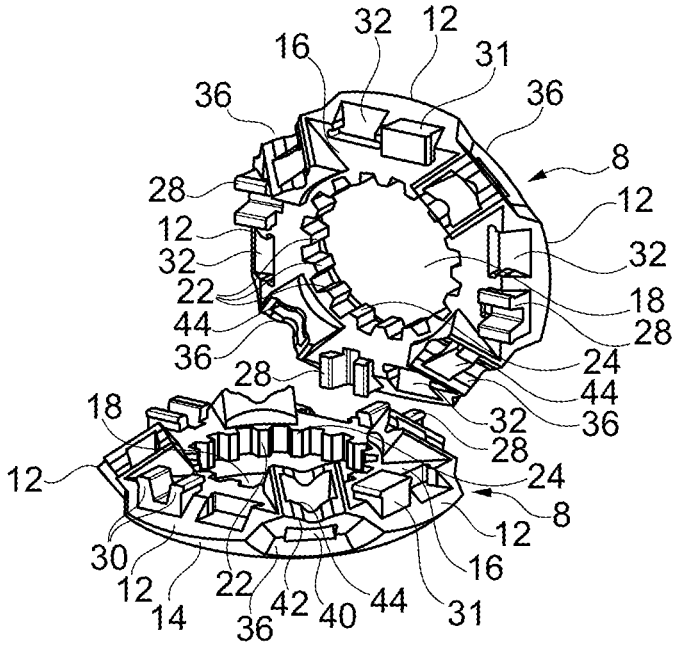
Figure 2B:
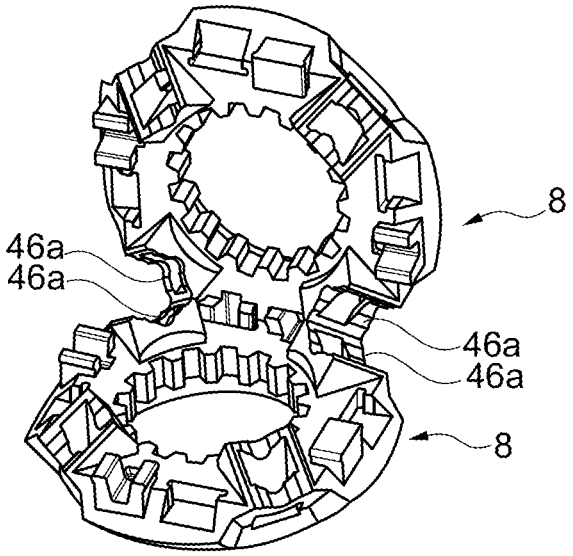
Figure 2C:
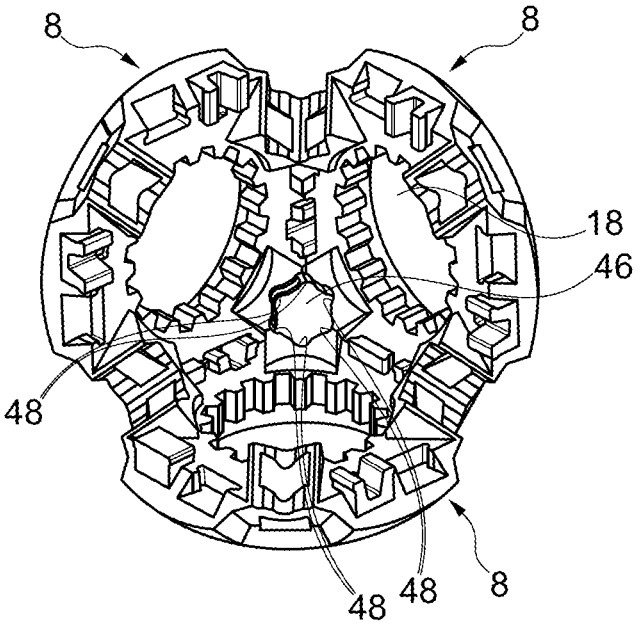
Figure 2D:
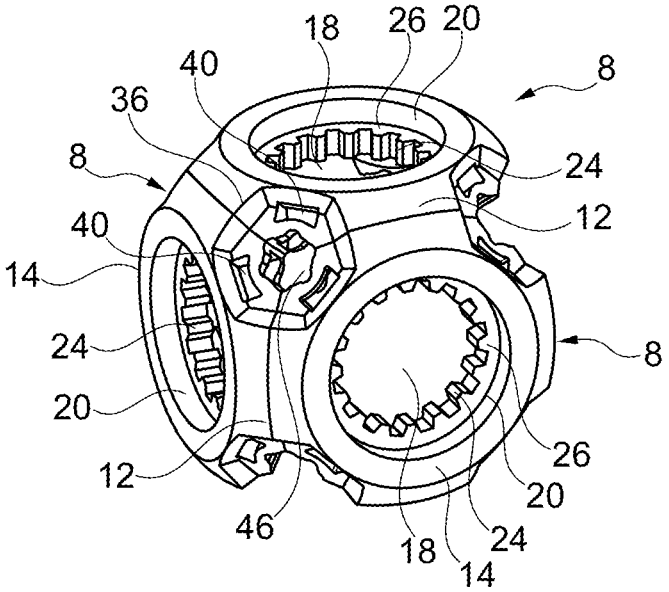
Figure 2E:
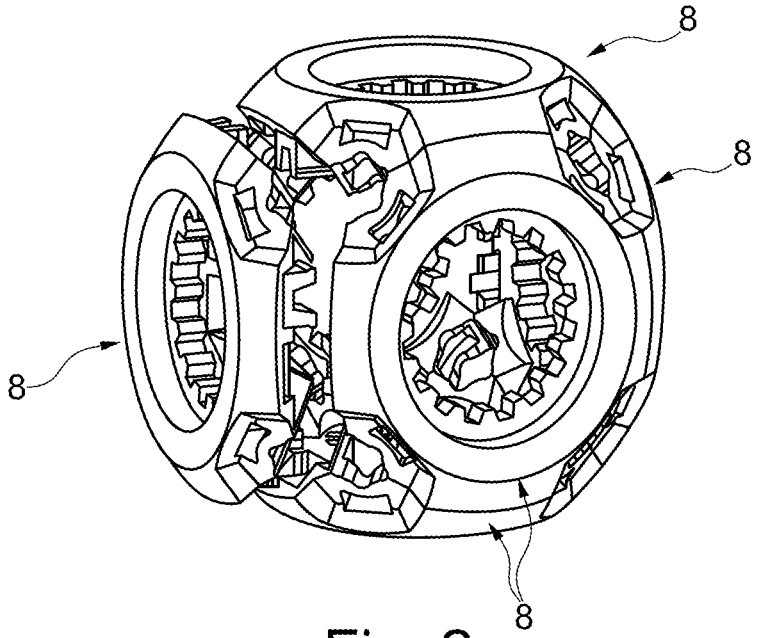
Figure 2F:
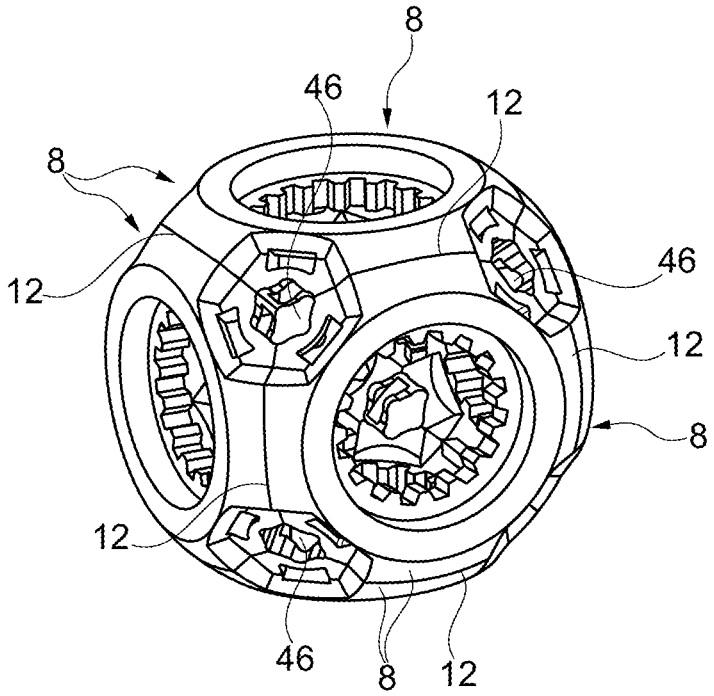
Figure 3:
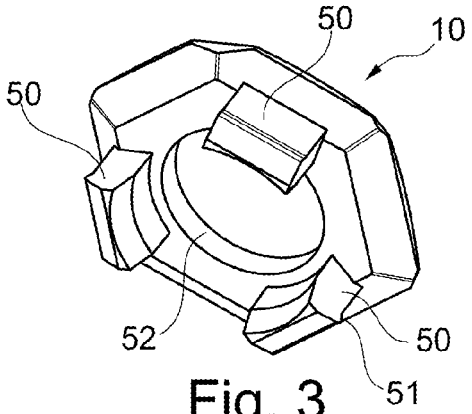
FIG. 3 is a perspective view of a locking piece of a building block.

The face walls 8 further comprise corner parts 36 formed at the intersection of the edges 12, each corner part defining part 46*a* of a corner opening 46 formed at the intersection of three assembled face walls 8 (see FIG. 2*c*). The corner opening is provided for inserting a corner connecting piece 6. Each corner part 36 comprises a locking part 38—in the illustrated embodiment a female locking part—comprising an orifice or a notch 40 for inserting a matching locking part 50 of a locking piece 10 (FIGS. 3 and 4*a*). The orifice 40 is delimited by a bearing strip 42 with an edge forming a locking shoulder 44.

With reference to FIGS. 2*a*, 3 and 4*a*, the locking piece 10 comprises at least three male locking parts in the form of tongues 50 having at their end a locking shoulder 51 configured to engage with the locking shoulder 44 of the bearing strip 42. The locking piece 10 also has an opening 52 to allow a corner connecting piece to be inserted in the corner opening 46 of the building block 2. The locking pieces 10 therefore allow the locking together of three adjacent face walls 8. In the illustrated embodiment, there are therefore eight locking pieces, one assembled to each of the eight corners of the pseudo-cubic building block. The bearing strip 42 may also be in the form of a beam having a certain elasticity configured to bear upon the tongue of the locking piece to eliminate clearance and improve the retaining of the locking piece in locked position on the face walls.

With more particular reference to FIG. 1 and FIGS. 5*a* to 5*e*, a face connecting piece 4 according to a first embodiment of the invention is illustrated. The face connecting piece is formed of two constituent elements 4*a* which, in their assembled position, can assume two stable positions. A first position allows the insertion or extraction of connecting pieces into and out of the openings of the face walls, and a second position ensures the coupling of the locking piece with adjacent face walls to hold them together. The two constituent elements pivot from one position to the other along the principle known from document WO 98/58716.

According to one variant, the two constituent elements may be pieces of identical shape, thereby reducing manufacturing costs. These pieces can be of injected plastic material or formed of other materials and using other methods. The manner of assembling and press fitting the pieces into one another may essentially be the same as for the connecting pieces known from WO 98/58716.

Each constituent element comprises a central body 54, wings 55 arranged in mirror symmetry offset from the central axis of the body, and means 56 for retaining the constituent elements. The central body 54 comprises an interface 58 against which the interface of the mating constituent element rests, and side walls 60*a* provided with press-fit means. The press-fit means are in the form for example of a bulge configured to engage in a portion of the wing of the mating constituent element to ensure the two stable positions of the connecting piece, namely the insertion position and the blocking position of the face walls.

In some variants (FIGS. 5, 6, 8) the wings comprise a bevelled leading edge 64 to facilitate their insertion through the opening 18 of the face wall, an abutment 70 and a groove 66 arranged between the abutment and a rear shoulder 65 of the leading edge 64. The rear shoulder 65 allows the engaging of the annular abutment of the central opening 18 of the face wall when withdrawing the connecting piece to cause the constituent elements to pivot from their blocking position to their insertion position when uncoupling building blocks. The abutment 70 of the wings abuts the rim 26 of the central opening when inserting the connecting piece to cause it to pivot from the insertion position to the blocking position when assembling building blocks.

In some variants (FIGS. 5, 8), the groove 66 is provided with teeth 68 mating with the teeth 22 of the face wall of the building block so that the connecting pieces are able to be blocked in rotation in multiple positions relative to the face wall. When the connecting piece is inserted in the opening of a face, at the time of rotating the constituent elements, the teeth of the face wall intermesh with the teeth in the grooves of the connecting piece. In the illustrated examples, the connecting piece is able to assume sixteen positions in rotation relative to face wall, adjacent teeth being spaced apart at an angle of 22.5°. It can be envisaged to have finer teeth spaced at a smaller angle to have a higher number of rotational positions.

With reference to FIGS. 7*a* to 7*d*, according to one variant, the connecting piece comprises a central, splined cavity or passageway 72 allowing a splined pin 75 (see FIG. 1*d*) to be inserted in the cavity and coupled in rotation with the connecting piece. Therefore rotation applied to the splined pin allows the rotation of the connecting piece and of the building blocks coupled to the connected piece.

According to some variants (FIGS. 7, 8) the connecting pieces can be provided with a groove 66 having teeth 68 on one side and a smooth groove 66' i.e. without teeth on the other side, so as to allow blocking in rotation of the connecting piece with a building block and to leave an adjacent block freely rotating. Therefore a splined pin inserted in the connecting piece allows one block to be rotated in relation to another or a group of blocks in relation to another group of blocks in a construction comprising a plurality of coupled building blocks.

According to another variant, some connecting pieces can be provided with a non-splined central passageway (not illustrated) having a sufficient diameter to allow the free passing and rotation of a splined pin inside the connecting piece. This makes it possible to insert a splined pin 75 through several building blocks to access a connecting piece having a splined cavity of a building block arranged inside a construction. In this manner, it is possible to rotate a block or group of blocks inside a construction without rotating the upstream blocks.

With reference to FIGS. 8*a* to 8*c* and 1*c*, according to one variant the connecting piece comprises teeth forming a pinion 74 on the leading edge of the wings. The pinion 74 is formed of two pinion parts 74*a* of the two constituent elements 4*a*" of the connecting piece 4". When connecting pieces are inserted through adjacent openings of a building block—in the illustrated examples these adjacent faces are orthogonal—the teeth of a pinion part of a connecting piece mesh with the teeth of the pinion part of the connecting piece on the other face wall. In this variant, the two orthogonal connecting pieces are therefore linked in rotation, the rotation of one connecting piece causing the rotation of the other with a ratio of 1:1. In this variant, the wings of the connecting piece on the side of the pinion 74 have a non-toothed groove 66' to allow the rotation of the connecting piece relative to a face wall.

According to one variant (FIG. 8*a*-8*d*) the connecting piece may comprise a pinion part 74 and a non-toothed groove 66' on one side and on the other side a groove 66 with teeth 68 so that it can be blocked in rotation relative to the adjacent building block. A transmission can therefore be formed by a first building block coupled to a second block by a first connecting piece, the second block coupled to a third block by a second connecting piece orthogonal to the first. The rotation of the first block generates rotation of the third block about a rotation axis orthogonal to the rotational axis of the first block.

According to another variant (see FIGS. 9*a*, 9*b* and 1*b*), the connecting piece may comprise a pinion part 74 on the two opposite sides of the connecting piece, the two grooves 66' being non-toothed.

According to a still further another variant (not illustrated) these connecting pieces with a pinion may also be provided with a splined central cavity to engage with a splined pin to cause the rotation of these connecting pieces via rotation of the pin.

Figure 1A:
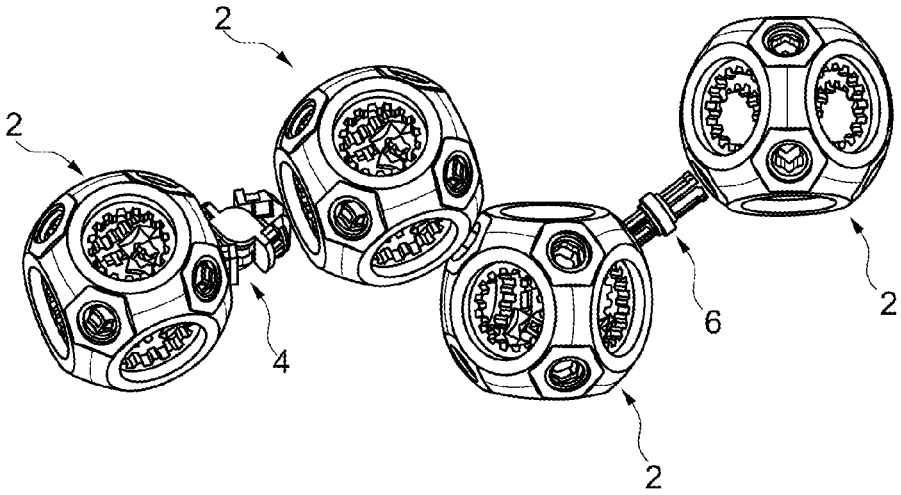
Figure 1B:
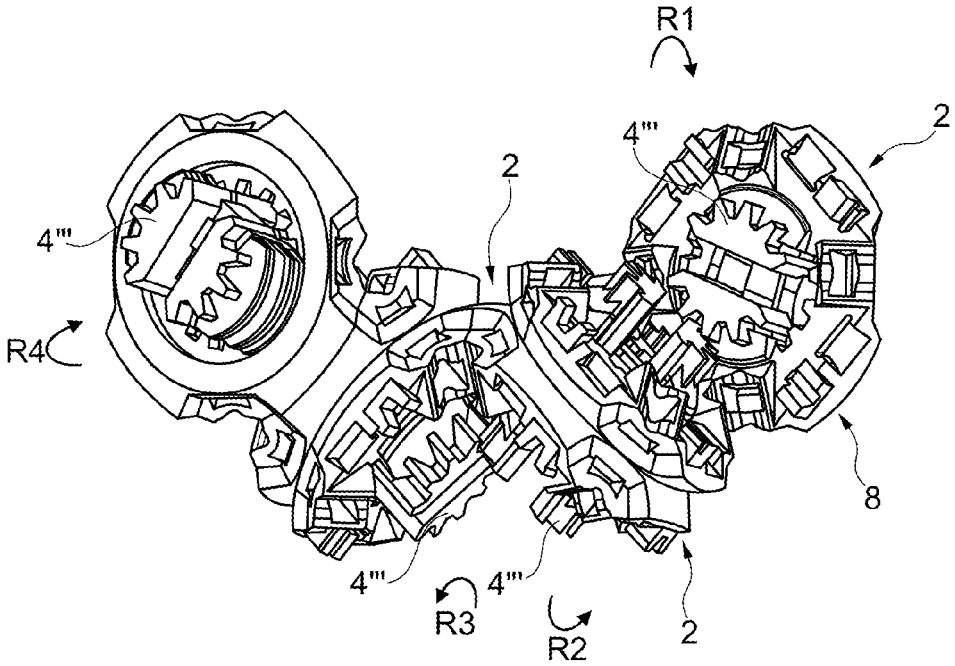
Figure 1C:
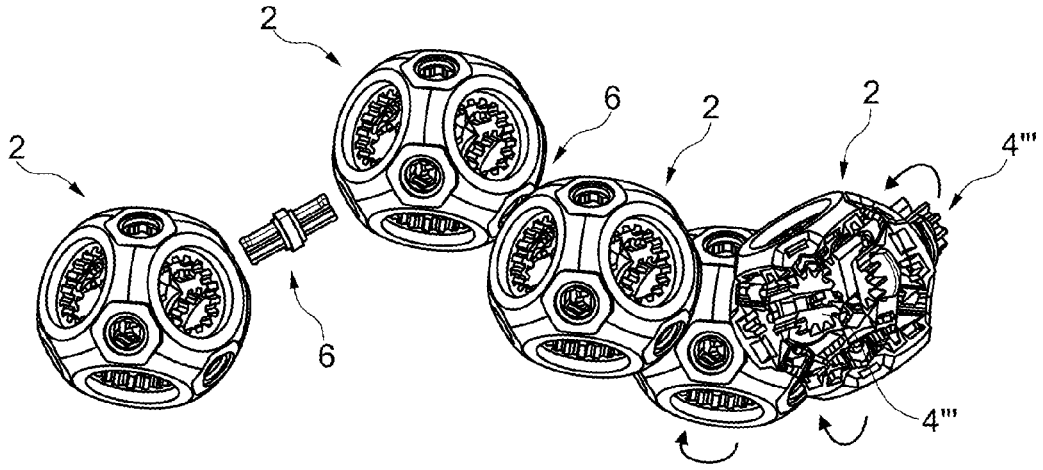
Figure 1D:
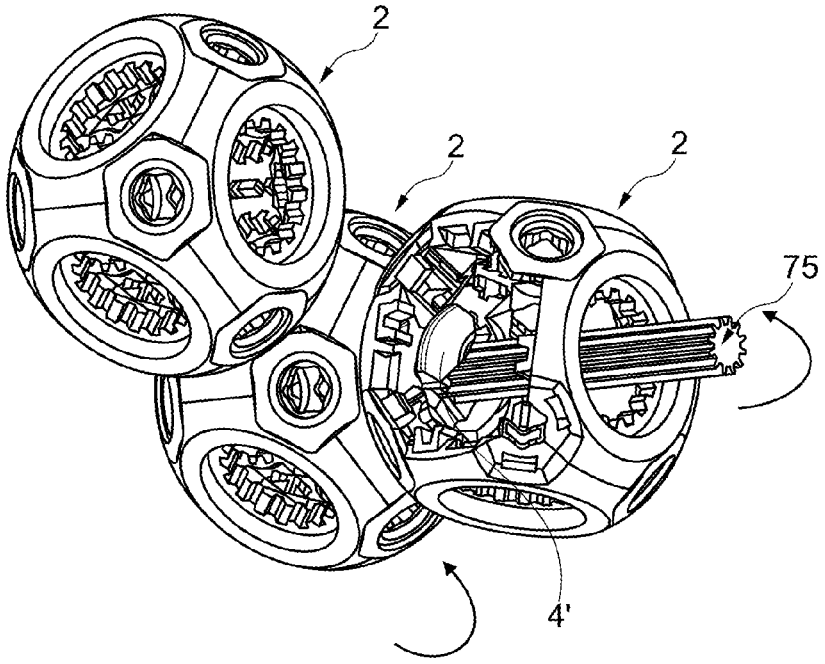

As illustrated in FIGS. 1*b*, 1*c* and 1*d*, some blocks can be coupled to other blocks via connecting pieces with pinions to form a complex transmission able to rotate a plurality of blocks or groups of blocks.

Variants of connecting pieces according to the invention may have different combinations of the following characteristics: one pinion or two pinions; splined or smooth central cavity; no central cavity; smooth grooves or toothed grooves, or one smooth groove and one toothed groove.

A construction can therefore integrate different variants of connecting pieces to obtain simple or multiple rotations of blocks or groups of blocks or output pins, by rotating blocks or groups of blocks or splined input pins.

With reference in particular to FIGS. 6*a*, 6*b* and FIGS. 1*a* and 2*c*, a corner connecting piece 6 according to one embodiment of the invention is illustrated. The corner connecting piece comprises a central body 76 and extensions 78 extending on opposite sides of this body. In the illustrated example, the extensions are in the form of pairs of elastic arms 78*a* having a profile mating with the corner openings 46 of the building block 2. At the end of the arms is a protuberance forming a retaining shoulder 82 configured to engage with the rear edge of the opening 46 to retain the corner connecting piece on the building block. The elastic arms 78*a* are separated by a space 79 enabling them to bend elastically towards each other, inter alia to allow their insertion in the corner opening 46. One or more bulges 80 on the arms are configured to engage in mating hollows 48 of the openings 46 to check the rotation of the connecting piece relative to the building block. The bulges and hollows can be rounded, as illustrated, to allow the rotation of the connecting piece from one stable position to the next stable position through elastic bending of the arms when the protuberance moves out of the hollows and then engages in the adjacent hollow. The corner connecting pieces may therefore be configured to allow the rotation of the building blocks relative to one another by "clicking" from one stable position to the next stable position. In the illustrated example, the corner openings have six hollows therefore defining six stable positions i.e. a rotation of 60° per click.

With reference to FIGS. 10 and 11, depending on variants, the corner connecting piece 6', 6" may comprise a central body 76', 76" with a pivot allowing the rotation of one building block relative to another about the pivot. The axis of rotation of the pivot may be orthogonal to the extensions inserted in the corner openings 46 of the building block 2 (FIG. 10) or essentially parallel to the extensions (FIG. 11). The extensions for these variants can be as described above in connection with FIGS. 6*a* and 6*b*.

According to one variant, the connecting piece 6" may have two extensions linked by a bridge element 77 on each side of the central body 76" with or without a pivot, the extensions being coupled to two corner openings of a building block as illustrated in FIG. 11. This makes it possible inter alia to provide coupling between blocks along the edges 12 i.e. an intermediate position between two corners 46.

LIST OF ELEMENTS REFERENCED IN THE FIGURES

Building System

2 Building block
8 Face wall
12 Edges
14 Outer face
16 Inner face
18 Opening (central)
26 Rim (annular)
22 Teeth
24 Minor annular periphery (tip of teeth)
20 Annular seat
28 Fixing part/male press-fit
30 Lug/Tongues
31 Point of injection
32 Fixing part/female press-fit
34 Notch
36 Corner piece (at intersection of the edges)
38 Locking part (female)
40 Orifice/Notch
42 Bearing strip
44 Locking shoulder
46 *a,b,c* Opening part (for corner connecting element)
48 Hollow
46 Opening (of corner)
10 Locking piece (element/corner cap)
50 Locking part (tongues)
51 Locking shoulder
52 Opening
4, 4', 4", 4'" Face connecting piece
4*a*, 4*a'*, 4*a"*, 4*a'"* Constituent elements
54 Central body
58 Interface
60 *a,b* Sides
62 retaining protuberances (press-fit means)
55 Wings
64 Bevelled leading edge
65 Rear shoulder
66 Groove (toothed), 66' Groove (non-toothed)
68 Teeth
70 Abutment
56 Retaining means of the constituent elements
72 Splined cavity
72*a* Splined cavity part
74 Pinion
74*a* Pinion part
75 Splined pin
6, 6', 6" Corner connecting piece (slot-in)
76, 76', 76" Central body
77 Bridge element
78 Extensions, 78 *a,b* Elastic arms
80 Bulge
79 Space
82 Shoulder/retaining protuberance

The invention claimed is:

1. An assembled building block of separate elements comprising face walls and locking pieces, the face walls having edges defining a contour of the face wall and an interface with adjacent face walls, the face walls comprising at least one male fixing part and one female fixing part arranged along each edge on an inner face, the male fixing parts mating with the female fixing parts, each locking piece being configured to be mounted onto a locking corner of the block arranged at the intersection of three adjacent face walls, each locking piece comprising at least three locking parts, one to engage with each of said three adjacent face walls.

2. The building block according to claim 1, wherein the locking piece comprises an opening for passing a corner connecting piece.

3. The building block according to claim 1, wherein the locking parts are in the form of tongues, each tongue comprising a locking bulge or shoulder at its end, configured to engage a mating locking shoulder of the face wall.

4. The building block according to claim 1, wherein the male fixing part is in the form of lugs or tongues and the female fixing part is in the form of a notch in which the tongues or lugs of the male fixing part are press-fitted.

5. The building block according to claim 3, wherein the locking corner of the face walls comprises at least three orifices in which the tongues of the locking piece are inserted, the orifices being delimited on one side by an elastic bearing strip defining the mating locking shoulder.

6. A construction kit including building blocks and face connecting pieces for coupling the building blocks, the building blocks comprising at least one face opening with a rim, the face connecting pieces comprising a pair of constituent elements pivoting relative to one another, the constituent elements each comprising a central body and wings configured to be inserted in the face opening, the wings comprising a groove arranged between a shoulder and an abutment, the abutment being configured to abut the rim of the face opening to cause the constituent elements to pivot from an insertion position to a blocking position, and the shoulder being configured to engage an inner face of the rim in the blocking position, wherein the rim of the face opening is toothed and comprises eight teeth or more distributed over the periphery of the face opening, and at least some of the face connecting pieces comprise teeth arranged in the groove of at least one of the constituent elements configured to intermesh with the teeth of the rim in the blocking position, the construction kit further comprising corner connecting pieces which can be slotted into corner openings of the building block, each corner connecting piece comprising elastic arms and a shoulder or retaining protuberance at their free end to engage an inner edge of the corner opening.

7. The construction kit according to claim 6, wherein the elastic arms comprise bulges.

8. The construction kit according to claim 6, wherein each corner connecting piece comprising a central body with a pivot allowing the rotation of a building block relative to another about the pivot.

9. The construction kit according to claim 6, wherein each corner connecting piece comprising a central body comprising a bridge element and a pair of extensions at each end of the bridge element configured to be coupled to two corner openings of the building block.

10. The construction kit according to claim 6 wherein at least some of the face connecting pieces comprise a splined central cavity configured for inserting a mating pin for rotation of the face connecting piece via the pin.

11. The construction kit according claim 6, wherein at least some of the face connecting pieces comprise a pinion extending over at least one side of the face connecting piece, configured to mesh with a pinion of another face connecting piece when the face connecting pieces are mounted in a building block.

12. The construction kit according to claim 11, wherein at least some of the face connecting pieces comprise two pinions on opposite sides of the face connecting piece.

13. The construction kit according to claim 10, wherein at least some of the face connecting pieces comprise a pinion extending on either side of the teeth arranged in the groove configured to intermesh with the teeth of the rim in the blocking position.

* * * * *